US006830200B1

(12) United States Patent
Jordan et al.

(10) Patent No.: US 6,830,200 B1
(45) Date of Patent: Dec. 14, 2004

(54) MOLD SPRAYING SYSTEM

(75) Inventors: Todd Jordan, Graham, NC (US); Tamotsu Kageshita, Chapel Hill, NC (US); Kazuo Nishio, Chapel Hill, NC (US); Bob Queen, Graham, NC (US)

(73) Assignee: Honda Motor Co., Ltd., Tokyo (JP)

( * ) Notice: Subject to any disclaimer, the term of this patent is extended or adjusted under 35 U.S.C. 154(b) by 45 days.

(21) Appl. No.: 09/918,606

(22) Filed: Jul. 31, 2001

(51) Int. Cl.[7] ..... B05B 17/00; B22C 3/00; B22D 27/00

(52) U.S. Cl. ..... 239/1; 164/72

(58) Field of Search ..... 239/1; 164/72, 164/472, 267, 268

(56) References Cited

U.S. PATENT DOCUMENTS

| | | | | |
|---|---|---|---|---|
| 4,086,953 A | | 5/1978 | Kraklau | 164/312 |
| 4,293,024 A | | 10/1981 | Kikuchi et al. | 164/303 |
| 4,655,280 A | | 4/1987 | Takahashi | 165/47 |
| 4,721,150 A | | 1/1988 | Thurner | 164/267 |
| 4,770,225 A | | 9/1988 | Takagi et al. | 164/305 |
| 5,111,873 A | | 5/1992 | Kordovski et al. | 164/312 |
| 5,435,373 A | * | 7/1995 | Drane et al. | 164/72 |
| 5,495,917 A | * | 3/1996 | Pax | 184/7.4 |
| 5,531,085 A | * | 7/1996 | Hayes | 72/43 |
| 5,638,893 A | * | 6/1997 | Sankaran et al. | 164/472 |
| 6,073,676 A | * | 6/2000 | Hairy et al. | 164/4.1 |

* cited by examiner

*Primary Examiner*—Michael Mar
*Assistant Examiner*—Darren Gorman
(74) *Attorney, Agent, or Firm*—Standley Law Group LLP

(57) ABSTRACT

A mold spraying system for emitting one or more sprayable materials onto portions of a mold, such as a die-cast mold, while the mold is located in a molding machine. The spraying system has an emitter, such as a spray head, for directing the one or more materials onto portions of each half of the mold when the mold is in an opened position between molding cycles of the molding machine. The spray head is connected to a manipulator for positioning the spray head between the mold halves. A pressure boosting unit is employed to ensure that the sprayable materials are supplied to the spray head at a sufficient pressure, notwithstanding any system pressure losses and/or the high frequency of spraying operations required to be performed as a result of a short molding machine cycle.

17 Claims, 3 Drawing Sheets

MOLD SPRAYING SYSTEM

BACKGROUND AND SUMMARY OF THE INVENTION

The present invention is directed to a spraying system for spraying one or more materials onto a mold used for producing molded components. More specifically, the present invention comprises a system that can spray one or more materials onto a mold, such as a die-cast mold, while the mold is located in a molding machine running with a short cycle time, and wherein the supply pressure of the materials can be sufficiently maintained despite the high frequency of machine cycles.

While the spraying system of the present invention may be applicable to a variety of molding processes, for purposes of simplicity and clarity, the spraying system will be described below only with respect to its use in a die-casting process. Die-casting is a well known process whereby metallic components can be quickly and accurately molded from a molten metal. Metals commonly employed in die-casting operations may include, for example, aluminum, zinc, brass and magnesium. Modern die-casting processes are able to create products with good dimensional tolerances and appearance. Die-casting is often used to produce components for, among others, the automotive, industrial, electronics, and building product industries.

The die-casting process is similar to that of injection molding, with a significant exception being the substitution of a molten metal material for a molten plastic material. Once the design of a desired component has been generated, a die-cast mold is manufactured to produce the component. Die-cast molds are commonly produced from tool steel or one of a multiplicity of metal-alloys. Like plastic injection molds, die-cast molds generally have two halves, consisting of a cavity side and a core side. There may also be moveable cores on such a mold that can be moved into position during molding and then later retracted to facilitate removal of the molded component from the mold.

Once a satisfactory die-cast mold is produced, the mold is placed in a die-casting machine. Die-casting machines are typically horizontally oriented injection-type machines having a fixed platen and a moving platen for holding the separate halves of the die-cast mold. The moving platen is typically moveable with respect to the fixed platen along a series of tie bars and guide plates, such that the mold halves may be brought into contact during the molding cycle of the machine and then withdrawn to allow for removal of the molded component. The moving platen is typically caused to move via hydraulic power, although electric power has also been used. An apparatus is provided at the die-casting machine for supplying molten metal for the molding process. With the mold halves in forced contact between the fixed and moving platens of the die-casting machine, a hydraulic plunger forces a predetermined amount of the molten metal to travel through an injection barrel and into the mold. The molten metal is then held within the mold, under pressure, while the molded component cools or cures. After a predetermined amount of time the moving platen and accompanying mold half are withdrawn, and the molded component is ejected from the mold half or is withdrawn by a secondary device, such as a part removal robot.

In order to effectuate removal of a molded part from a mold it is generally necessary to treat at least the portions of each mold half contacted by the molten metal material with a release agent. The release agent essentially forms a thin barrier between the surfaces of the mold and the molten metal, thereby helping to prevent the molten metal from bonding to the mold. Because injection of the molten metal into the mold and subsequent removal of the molded component therefrom substantially removes or degrades the release agent, it is typically necessary to apply release agent to the mold prior to each molding cycle.

During the molding process, molten metal material may creep into small defects in the mold, or may partially invade the parting line that occurs between the flush-mating surfaces of the mold halves. This may result in the formation of what is typically referred to as flash—thin areas of excess material that are often attached to a molded component. Portions of this flash can often become detached from the molded component during separation of the mold halves or during removal of the component from the mold. These detached portions can remain on various portions of either mold half, such as on a core or cavity portion, or on the flat, mating surfaces that form the shut-off between the mold halves. Flash, or other contaminants that find their way onto the mold can cause defects in one or more subsequently molded parts, or may, if allowed to build up, prevent complete mating of the mold halves. To prevent such a situation from occurring, the mold halves are preferably cleaned off in between each molding cycle. As it would not be practical to perform a hand-cleaning of die-cast molds between molding cycles, cleaning is typically accomplished using high-pressure air. The high-pressure air is directed against each mold half to dislodge any flash or other contaminants that may be residing thereon.

Due to the molten state of the metal used to form die-cast components, die-cast molds typically become extremely hot during the die-casting process. As a consequence, it is generally necessary to cool a die-cast mold while in use, so that the mold temperature can be maintained within a desired range and so that the components molded therein can properly cool in an acceptable period of time. To this end, die-casting operations usually employ a chilled water system to supply chilled water to the die-cast mold. The chilled water may be moved through passageways occurring within the mold halves. Additionally, in order to assist in the cooling of the mold, it is also desirable to spray, or otherwise apply a die-lubricant to the molding surfaces of the mold halves between machine cycles.

In order for die-casting to be cost-effective, it is typically necessary that a large quantity of die-cast components be produced. In this manner, it is possible to spread out the cost of what is often a costly die-cast mold over a large number of components molded therefrom. To facilitate cost-effectiveness, it is also desirable that the die-casting machine used to produce the components be operated in the most efficient manner. Thus, the fastest molding cycle possible is usually sought out. To obtain a fast molding cycle, it is essential that part removal and any mold preparation, such as that previously discussed, be performed as quickly as possible. The requirement of haste, as well as safety, dictates that hand-cleaning of the mold halves and hand-application of a release agent and/or other substances thereto is not possible. As such, each of these processes is typically administered to by an automated device or devices.

Automated devices for performing die-cast mold cleaning and/or the application of release agents and other substances thereto, must perform their particular function within a limited amount of time. The faster the die-cast machine cycle, the less time available for these ancillary functions. Earlier, known devices placed spraying mechanisms on retractable cylinders, or masts, that could be lowered into the space between the mold halves once the molded component had been removed. However, these known devices had several undesirable characteristics, such as, for example, the residing thereof directly over the mold halves—which could allow for such a device to fall between the mold halves during certain portions of the molding cycle. Consequently, other systems have been developed that do not require the spraying device to reside substantially over the meeting point of the mold halves, but still allow the spraying mechanism to be lowered into the open mold between machine cycles. While these known systems may recite methods of moving a spraying device into position between the mold halves, they have not considered other problems inherent with short cycle-time die-cast molding; namely, effecting proper cooling of the die-cast mold, and maintaining sufficient supply pressures so that release agents, air, and other substances may be quickly and acceptably applied to the mold. The present invention addresses these problems.

The present invention is directed to a system for providing the necessary mold spraying operations—particularly with respect to a short cycle-time molding operation, such as die-cast molding. The present invention recites an automated spraying device that preferably employs a spray head mounted to a manipulator arm. The manipulator arm is preferably mounted on a top of surface of the die-casting machine or, alternatively, to the top of the fixed platen of the machine. The path and range of motion of the manipulator arm are preferably adjustable, thereby allowing the spray head to be lowered between open mold halves at the appropriate time during the molding cycle. The spray head also employs novel supply circuitry that allows a supply of pressurized air, release agent, and/or other materials to be applied to the mold halves at a sufficient and substantially constant pressure, even if there is a decrease in the supply pressure of the materials. In order to effectuate proper cooling of the die-cast mold, a die-lubricant is preferably one of the materials applied to the mold halves by the spray head, either independently, or as a mixture with another material. The design of the supply circuitry utilizes a pressure boosting unit that permits the spray head to apply the desired materials at a substantially constant pressure, even when used on die-casting machines having extremely short cycle-times. Preferably, operation of the spray system is governed by a control device, such as, for example, a series of relays and contacts, a personal controller or, more preferably, a programmable logic controller (PLC).

BRIEF DESCRIPTION OF THE DRAWINGS

In addition to the novel features and advantages mentioned above, other objects and advantages of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

The present invention consists of a mold spraying system for use in a molding process, wherein the mold spraying system is able to provide an adequate spraying pressure to a spray head thereof despite system pressure losses, and despite a high frequency of spraying cycles. While it should be realized by one skilled in the art that the spraying system of the present invention may be applicable to a variety of molding processes, for purposes of illustration, and not limitation, the spraying system will be described below especially with respect to its use in a die-casting process. The embodiment of the spraying system of the present invention depicted in FIGS. 1–3 allows for the spraying of one or more materials onto the molding surfaces of a die-cast mold—while halves of the mold are separated during the molding cycle. The spraying system of the present invention further permits the materials to be sprayed onto the mold at an acceptable and substantially constant pressure, even when the cycle-time of the die-casting machine in which the die-cast mold resides is short and the machine produces many cycles.

Figure 1:
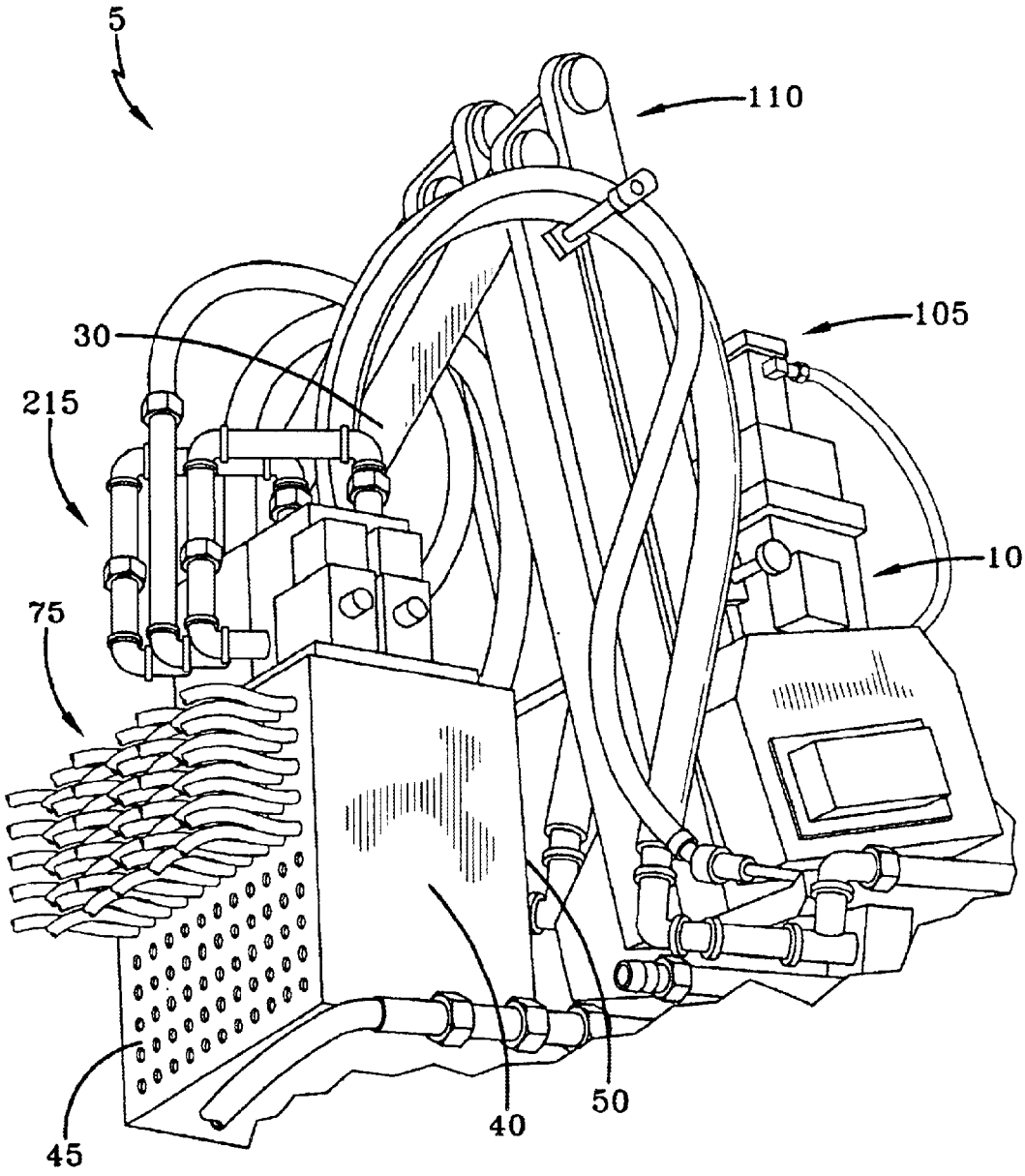
FIG. 1 shows an exemplary embodiment of a die-cast mold spraying device of the present invention mounted to a portion of a typical die-casting machine and in a retracted (non-spraying) position.
Figure 2:
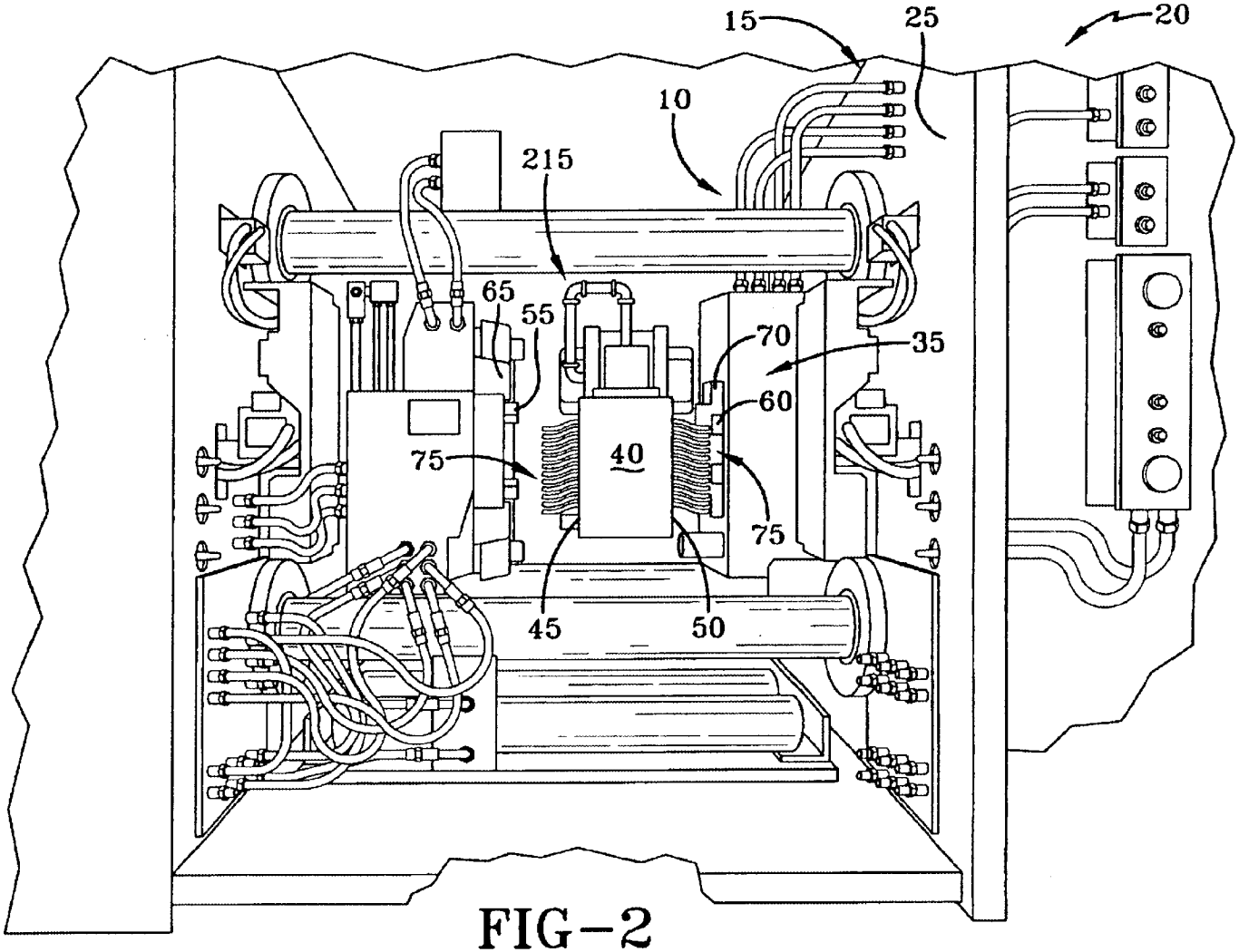
FIG. 2 illustrates an exemplary embodiment of a spray head portion of the die-cast mold spraying device of FIG. 1 in the spraying position between open halves of a die-cast mold.

A portion of one embodiment of a spraying system 5 of the present invention can be seen by reference to FIGS. 1–2. In this embodiment, a manipulator arm 10 is shown to be attached to a top surface 15 of a die-casting machine 20. The manipulator arm 10 could also be attached to a side surface, or to a top surface of the fixed platen 25 of the die-casting machine 20, if the platen is of sufficient size. As will be described infra, in the embodiment of the present invention depicted in FIGS. 1–2, the manipulator arm 10 is controlled by a series of hydraulic cylinders. However, it should be realized by one skilled in the art that the manipulator arm 10 could also be controlled by pneumatic cylinders, electric motors or other drive means, or alternatively, may be a robotic arm with programmable control. In the embodiment shown in FIGS. 1–2, the manipulator arm 10 is designed to travel some horizontal distance substantially along the longitudinal axis of the die-casting machine 20, and is also designed to allow its distal end 30 to move between various vertical positions—from above the molding area of the die-casting machine to an area occupied by a die-cast mold 35 within the working envelope of the machine.

The distal end 30 of the manipulator arm 10 is attached to an emitter, such as the spray head 40 shown. Preferably, the spray head 40 is attached to the manipulator arm 10 by a pivoting joint (not shown), so that the vertical discharge faces 45, 50 of the spray head remain substantially perpendicular to the ground and substantially parallel to the molding surfaces 55, 60 of the die-cast mold 35 when the manipulator arm 10 is moved. The spray head 40 is configured to provide the pressurized emission of one or more materials onto the molding surfaces 55, 60 of the die-cast mold 35, when the die-cast mold is separated into halves 65, 70 between molding cycles of the molding machine.

Figure 3:
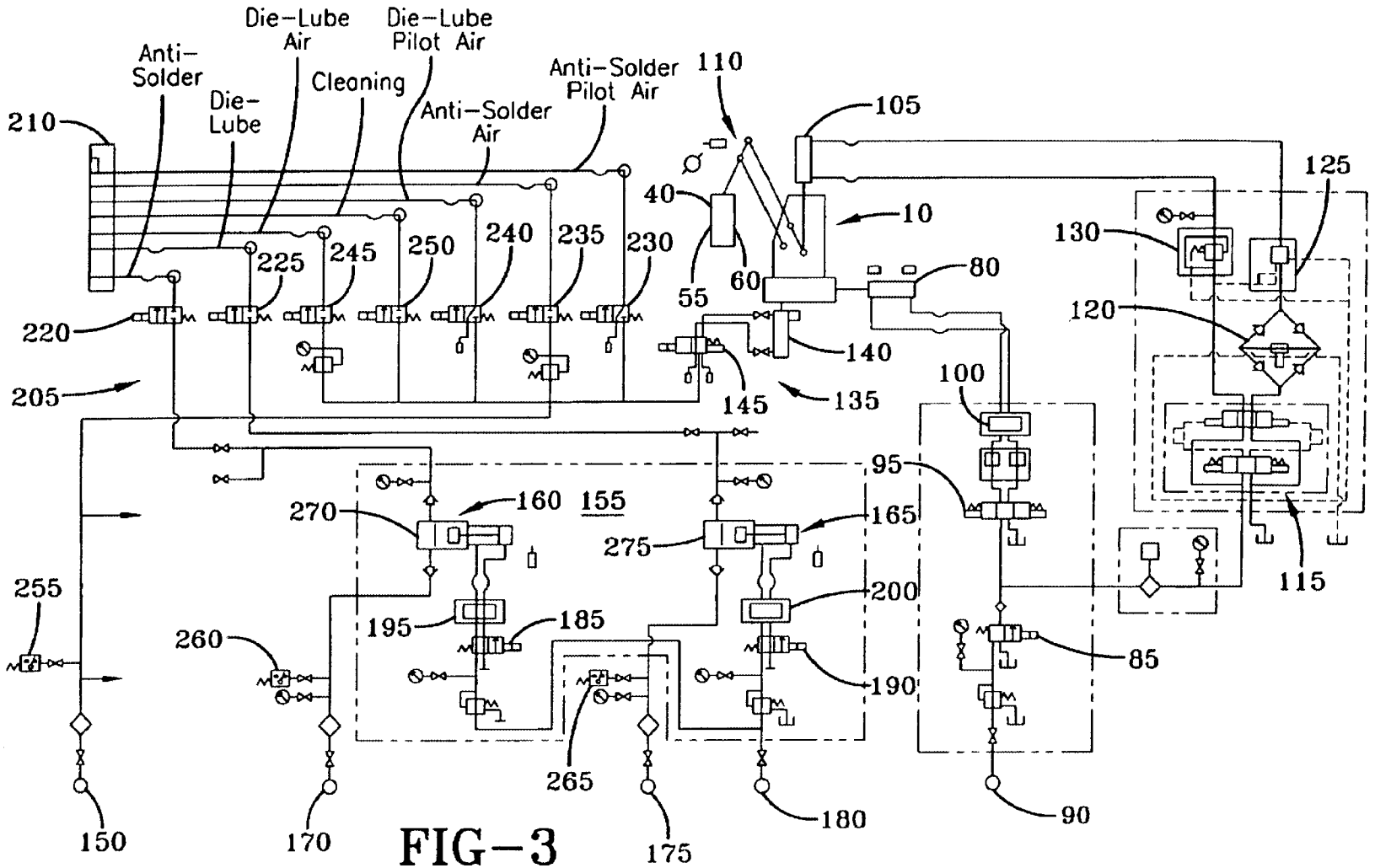
FIG. 3 is a schematic diagram depicting an exemplary pneumatic and hydraulic supply circuit for supplying numerous materials to the spray head shown in FIGS. 1–2, and for causing movement of the spraying device.

As can be seen in FIG. 3, the spray head 40 may be used to spray, for example, an anti-solder material, a die-lubricant, pressurized air, and/or a number of other materials and combinations thereof. An anti-solder material is typically used to help prevent the molten metal from adhering to the molding cavity, or cavities, in the die-cast mold 35. In order to prevent cracks from occurring in the cavity as a result of exposure to excess heat, a die-lubricant is typically employed to help cool the molding cavity, or cavities. The spray head 40 may have a plurality of nozzles 75 (FIGS. 1 and 2) for directing the various materials supplied thereto onto the die-cast mold 35. The nozzles 75 may be of various size and shape, and may extend outwardly from one or both of the discharge faces 45, 50 of the spray head 40. To better target particular areas of the die-cast mold 35, such as the molding cavities, the nozzles 75 may incorporate bent tubing, or flexible tubing that may be bent to the proper shape in order to obtain the desired spray path. The nozzles 75 may consist of the tubing itself, or may further utilize nozzle tips that can produce spray patterns of various size and shape.

As discussed above, during the die-casting process flash may be formed as a result of molten metal entering into the parting line or small imperfections in the mold. Portions of this flash can often become detached from the molded component during separation of the mold halves or during removal of the component from the mold, and may remain on various portions of either mold half, such as on a core or cavity portion, or on the flat, mating surfaces that form the shut-off between the mold halves. It is important that any flash or other contaminants that find their way onto the mold between molding cycles be substantially removed, as such contaminants can cause defects in one or more subsequently molded parts, or may, if allowed to build up, prevent complete mating of the mold halves. In the present invention, high-pressure air is preferably used to accomplish this task. The high-pressure air is directed from one or more nozzles 75 on the spray head 40 against portions of each mold half 65, 70.

Referring again to FIG. 3, a schematic diagram representing one embodiment of a hydraulic and pneumatic system of the present invention can be observed. Other embodiments of a hydraulic and pneumatic system employing a somewhat different collection or arrangement of components may also be employed with satisfactory results. Movement of the manipulator arm 10 is shown to be controlled by two separate hydraulic cylinders. A hydraulic traverse cylinder 80 is preferably provided to cause a linear motion of the manipulator arm 10 substantially along the longitudinal axis of the die-casting machine 20. In this manner, the manipulator arm 10 may move between positions that are retracted from, or in proximity to, the edge of the stationary platen of the die-casting machine 20. A supply solenoid valve 85 is provided for controlling a supply of pressurized hydraulic fluid from a manipulator hydraulic source 90 to the hydraulic traverse cylinder 80. A traverse solenoid valve 95 is also provided to control the linear movement of the manipulator arm 10 in response to signals from a programmable logic controller (PLC) (not shown). A speed control device 100, such as the flow control device shown, is also preferably inserted in the hydraulic lines leading from the traverse solenoid valve 95 to the hydraulic traverse cylinder 80, in order to afford control over the speed of linear travel achieved by the manipulator arm 10.

A lifting hydraulic cylinder 105 is coupled to the manipulator arm 10 for moving the spray head 40 between a retracted (raised) position (see FIGS. 1 and 3) and a working (lowered) position (see FIG. 2) within the platens of the die-casting machine 20 and the open mold halves 65, 70. In this particular embodiment of the present invention, the lifting hydraulic cylinder 105 is coupled to a linkage 110 that is connected to and moves the spray head 40. A pair of solenoid valves in fluid communication, form a lifting solenoid valve 115 that controls the movement of the spray head 40 between its retracted and working positions, in response to the appropriate signals from the PLC. Pressurized hydraulic fluid from the manipulator hydraulic source 90 is routed to the lifting hydraulic cylinder 105 via the supply solenoid valve 85 and lifting solenoid valve 115. Hydraulic fluid preferably passes from the raising side of the lifting solenoid valve 115 through a digital flow control valve 120 and a pilot check valve 125, before traveling to the extension port of the lifting hydraulic cylinder 105. A reducing valve 130 may be provided in the hydraulic line leading from the lowering side of the lifting solenoid valve 115 to the retracting port of the lifting hydraulic cylinder 105. By this combination of solenoid valves 85, 95, 115 and hydraulic cylinders 80, 105, desired movement of the manipulator arm 10 and spray head 40 may be accomplished.

For purposes of safety, it is also preferable that non-desired movement of the manipulator arm 10 and spray head 40 be prevented. To this end, a lock-out device 135 is preferably provided for prohibiting movement thereof when the lock-out device is activated. In this embodiment, the lock-out device employs a pneumatic cylinder 140, which activates a safety hook that engages a portion of the manipulator arm 10 to prevent the non-desired movement thereof. The lock-out device 135 is controlled by a pneumatic solenoid valve 145 that transports pressurized air to the cylinder 140 from a pressurized air source 150, and shifts in response to electronic signals from the PLC.

A booster unit 155 is provided in the present invention to increase the pressure of one or more of the materials being transported to, and emitted from, the spray head 40. In this particular embodiment of the present invention, the booster unit 155 is used to increase the pressure of an anti-solder material and a die-lubricant. To accomplish the pressure increase, force-exerting cylinders, such as the hydraulic booster cylinders 160, 165 shown, are provided to act on the respective material as it travels from a pressurized anti-solder material source 170 and a pressurized die-lubricant source 175 to the spray head 40. As can be seen in FIG. 3, a booster unit hydraulic source 180 provides pressurized hydraulic fluid for operating the hydraulic booster cylinders 160, 165. Each hydraulic booster cylinder 160, 165 is controlled by a corresponding booster unit solenoid valve 185, 190 that receives and responds to electronic signals from the PLC. Preferably, a speed control device 195, 200, such as the flow control device shown, is employed to regulate the speed at which each hydraulic booster cylinder 160, 165 extends and retracts.

Still referring to FIG. 3, the various material supply lines 205 leading to the spray head 40 may be observed. As represented in FIG. 3, each of the supply lines 205, which typically consist of some form of rigid conduit, is shown to terminate at a manifold 210 or a similar device (not shown in FIGS. 1 and 2). The manifold 210 may be mounted at various locations but, preferably, is mounted to the molding machine and in relative proximity to the spray head 40. Flexible tubing or hoses are then preferably employed to transport the materials from the manifold 210 to the spray head 40, so that movement of the manipulator arm 10 and spray head is not restricted. The anti-solder material and die-lubricant may also be routed through one or more atomizer units 215, preferably mounted on the spray head 40, in order to better control emission of the anti-solder and die lubricant materials therefrom.

Prior to reaching the manifold each of the material lines is directed through a corresponding pneumatic solenoid valve for controlling the emission of each material from the spray head 40. As can be seen, an anti-solder material and a die-lubricant are supplied to the spray head 40 from the anti-solder source 170 and die-lubricant source 175, respectively. Each of the anti-solder material and die-lubricant are directed to the spray head 40 by a corresponding pneumatic solenoid valve 220, 225 that is in electronic communication with the PLC. Pressurized air from the pressurized air source 150 is also routed to the spray head 40. The pressurized air is directed through an anti-solder pilot air solenoid valve 230, an anti-solder air solenoid valve 235, a die-lubricant pilot air solenoid valve 240, a die-lubricant air solenoid valve 245, and a die cleaning solenoid valve 250. Each of the anti-solder and die-lubricant air solenoid valves 220, 225, transfers pressurized air to the spray head 40 for the purpose of dispersing each of the anti-solder and die-lubricant materials, respectively. A pressure switch 255, 260, 265 is preferably also in communication with each of the respective supply lines leading from the pressurized air source 150, the anti-solder source 170, and the die-lubricant source 175 to the spray head 40. Each of the pressure switches 255, 260, 265 may be used to announce a low pressure condition in the respective supply line to which it is connected, such as by activating an alarm or other indicator.

During the mold spraying operation, the manipulator arm 10 is moved into position so that the spray head may be properly located between the open halves 65, 70 of the die-cast mold 35. The anti-solder material, die-lubricant, and air are supplied to the spray head from each of their respective pressurized sources 150, 170, 175. During the spraying operation, it has been found, for various reasons, that it is often difficult to adequately maintain the pressure of the anti-solder and die-lubricant materials that are supplied to the spray head 40. As these materials are often stored at a considerable distance from the die-casting machine 20 with which they will be used, a pressure drop may occur as a result of transporting the materials to the spray head 40. The relatively high specific gravity of these materials in comparison to air, generally makes them more difficult to transport over long distances at substantial pressure. In addition to this problem, it has also been found that when a mold spraying system is employed on a die-casting machine with a short cycle tire, it is often difficult to maintain the pressure of the materials supplied to the spray head 40 such that the materials may be emitted at a sufficient pressure therefrom at the frequency dictated by the machine cycle.

To overcome the above deficiencies, the present invention routes each of the anti-solder, die-lubricant, and other similar materials to be applied to the die-cast mold through the booster unit 155 prior to their arrival at the spray head 40. As is illustrated in FIG. 3, each of the anti-solder material and die-lubricant travel through a chamber 270, 275 attached to the corresponding hydraulic booster cylinder 160, 165. During the molding cycle of the die-casting machine 20, when the die-cast mold 35 is closed and the spray head 40 is not in use, the pistons within each booster unit hydraulic cylinder 160, 165 are retracted and the anti-solder and die-lubricant materials are supplied to the respective chamber 270, 275 attached thereto, as well as to the supply lines leading therefrom to the manifold 210. Upon the end of the molding cycle and the corresponding opening of the mold and ejection of the molded component, the manipulator arm 10 is activated by the PLC to position the spray head 40 between the open mold halves 65, 70. The PLC also sends an electronic signal to the booster unit solenoid valves 185, 190 to cause the extension of the piston within each booster unit hydraulic cylinder 160, 165. The extension of the piston within each booster unit hydraulic cylinder 160, 165 causes a reduction in the volume of the corresponding chamber 270, 275 attached thereto and, consequently, an increase in the pressure of the anti-solder and die-lubricant materials residing therein and/or passing therethrough.

The timing of the electronic signals from the PLC to the manipulator arm 10 and each of the booster unit solenoid valves 185, 190 is such that, the anti-solder and die-lubricant materials can be supplied at an increased pressure from the respective chambers 270, 275 to the spray head 40 as frequently as is required. Upon completion of the spray cycle, each of the hydraulic booster cylinder pistons retracts to prepare for the next spray cycle, thereby permitting additional material to flow into the chambers 270, 275 attached to the hydraulic booster cylinders 160, 165.

The spraying system of the present invention also allows for various sequencing and timing of the individual materials emitted by the spray head 40. Use of the PLC and the pneumatic solenoid valves allows certain of the materials to be applied before or after others, and permits each of the materials to be emitted for a particular time. For example, in one particular embodiment of the present invention, pressurized air is first emitted by the spray head 40 in order to remove flash and/or other debris from the mold. The die-lubricant is next applied to the mold, followed by additional pressurized air, the anti-solder material, and a further application of pressurized air. Each of these materials may be emitted for a like amount of time or, alternatively, various spray times may be utilized.

From the foregoing description, it can be seen that the spraying system of the present invention affords the spraying of one or more materials onto a die at a predetermined and substantially constant pressure—even when the supply pressure of the one or more materials is less than desired and even when a relatively high frequency of mold spraying operations must be performed. By providing a booster unit in-line with the supply of the one or more materials, it can be ensured that a predetermined spraying pressure of the materials can always be attained.

It should be realized by one skilled in the art that, although, for purposes of clarity, the spraying system of the present invention has been described in detail above only with respect to its use in a die-casting process, the spraying system of the present invention may also be utilized in other molding processes, such as, for example, plastic injection molding. It should also be realized that while certain components are shown to be included in the hydraulic and pneumatic system of the present invention, not all of said components are necessary to practice the present invention, and certain components may be deleted and/or other components may be substituted therefor without departing from the spirit and scope of the present invention. As such, while certain embodiments of the present invention are described in detail above, the scope of the invention is not to be considered limited by such disclosure, and modifications are possible without departing from the spirit of the invention as evidenced by the following claims:

What is claimed is:

1. A method of ensuring that a sprayable material is consistently supplied to the emitter of a mold spraying system at a sufficient pressure, said method comprising:

providing a pressurized source of said sprayable material, said source connected to said emitter by a conduit;

locating a chamber at some point between said source of said sprayable material and said emitter, such that said conduit passes therethrough;

coupling a force-exerting cylinder to said chamber;

providing a control device for actuating said force-exerting cylinder in preparation for operation of said emitter; and providing a speed control device for regulating the speed of said force-exerting cylinder;

whereby said force-exerting cylinder exerts a force on said material in said chamber as required to cause said material to be consistently transported to said emitter at substantially some predetermined pressure.

2. The method of claim 1, further comprising providing a solenoid valve in electronic communication with said control device for actuating said force-exerting cylinder.

3. The method of claim 1, further comprising prohibiting the flow of sprayable material of increased pressure from said chamber toward said source.

4. The method of claim 1, wherein said sprayable material is supplied to said emitter at a substantially constant pressure.

5. The method of claim 1, wherein more than one sprayable material is supplied to said emitter.

6. The method of claim 5, wherein each of said sprayable materials passes through said chamber.

7. The method of claim 5, wherein only one, or selected ones, of said sprayable materials passes through said chamber.

8. The method of claim 1, wherein said pressurized source of sprayable material is located remotely from said emitter.

9. A method of ensuring that an emitter of a mold spraying system is able to consistently spray one or more sprayable materials onto a mold or die at an adequate pressure, said method comprising:

providing a pressurized source of said one or more sprayable materials;

providing an emitter located to spray said one or more sprayable materials onto a die or mold for treatment thereof;

connecting said pressurized source of said one or more sprayable materials to said emitter by a conduit;

determining a minimum pressure at which said emitter must expel said one or more sprayable materials in order to properly treat said die or mold;

locating a pressure boosting device at some point between said pressurized source of said one or more sprayable materials and said emitter, such that said pressure boosting device is in communication with said conduit, said pressure boosting device further comprising;

a chamber for receiving an amount of sprayable material(s) from said pressurized source, via said conduit, a force-exerting cylinder coupled to said chamber for reducing the volume thereof, a control device for actuating said force-exerting cylinder, and a regulating means for controlling the amount of force that said force exerting cylinder exerts on said sprayable material(s) within said chamber;

whereby said force-exerting cylinder exerts a force on said sprayable material in said chamber as required to cause said sprayable material to be consistently transported to said emitter at a pressure equal to or greater than said minimum pressure; and whereby said one or more sprayable materials are consistently expelled from said emitter at an adequate pressure for properly spraying said die or mold, even when the pressure of said one or more sprayable materials supplied by said pressurized source is less than said minimum pressure.

10. The method of claim 9, further comprising providing a solenoid valve in electronic communication with said control device for operating said force-exerting cylinder.

11. The method of claim 9, further comprising prohibiting the flow of sprayable material of increased pressure from said chamber toward said source.

12. The method of claim 9, wherein said one or more sprayable materials are supplied to said emitter at a substantially constant pressure.

13. The method of claim 9, wherein each of said one or more sprayable materials passes through said chamber.

14. The method of claim 9, wherein only one, or selected ones, of said one or more sprayable materials passes through said chamber.

15. The method o f claim 9, wherein said pressurized source of sprayable material is located remotely from said emitter.

16. The method of claim 9, wherein said regulating means is a speed controller that controls the speed at which said force-exerting cylinder advances into said chamber.

17. The method of claim 16, wherein said speed controller also controls the speed at which said force-exerting cylinder retracts from said chamber.

* * * * *